United States Patent [19]

Kobler

[11] Patent Number: 4,896,870

[45] Date of Patent: Jan. 30, 1990

[54] COMPACT TRANSPORT AND STORAGE SYSTEM FOR FOLDED OR CONNECTED SHEET PRODUCTS

[75] Inventor: Ingo Kobler, Anhausen, Fed. Rep. of Germany

[73] Assignee: Man Roland Druckmaschinen AG, Offenbach am Main, Fed. Rep. of Germany

[21] Appl. No.: 344,472

[22] Filed: Apr. 26, 1989

Related U.S. Application Data

[63] Continuation of Ser. No. 132,989, Dec. 15, 1987, abandoned.

[30] Foreign Application Priority Data

Dec. 17, 1986 [DE] Fed. Rep. of Germany ..... 3643026

[51] Int. Cl.[4] ..... B65H 39/08

[52] U.S. Cl. ..... 270/60; 198/628; 271/216

[58] Field of Search ..... 270/54–58, 270/60; 198/423, 627, 628, 629; 271/213–216

[56] References Cited

U.S. PATENT DOCUMENTS

| | | | |
|---|---|---|---|
| 3,692,176 | 9/1972 | Templeton et al. . | |
| 3,842,712 | 10/1974 | Ferandez-Rana | 198/423 |
| 4,262,683 | 4/1981 | Daenen | 270/58 |
| 4,602,774 | 7/1986 | Kobler | 198/627 |
| 4,667,809 | 5/1987 | Raybuck | 198/627 |

FOREIGN PATENT DOCUMENTS

| | | | |
|---|---|---|---|
| 1153383 | 8/1963 | Fed. Rep. of Germany . | |
| 2354381 | 5/1974 | Fed. Rep. of Germany | 270/54 |
| 3319965 | 12/1983 | Fed. Rep. of Germany . | |

*Primary Examiner*—Robert E. Garrett
*Assistant Examiner*—Therese M. Newholm
*Attorney, Agent, or Firm*—Frishauf, Holtz, Goodman & Woodward

[57] ABSTRACT

To permit storage of folded products, an elongated storage strip of finite length includes carriers for the folded products, the folded products being placed in predetermined position against the strip such that the sheets engage with a surface facing the strip element. The strip element, at the same time, can function as a transport element, to receive the folded sheets therefor, and transport them to a storage position where, for example, the elongated element is rolled into a roll (FIG. 1) or where the elongated element can be placed in a rack, or suspended, with the folded product hanging thereon (FIGS. 18, 19). The strip element is formed with carriers which have hook ends, engageable beneath the fold of the folded elements, upon flexing of the folded products and/or the carriers, or pivoting of carrier fingers engageable behind the backs of the folded products (6).

18 Claims, 9 Drawing Sheets

COMPACT TRANSPORT AND STORAGE SYSTEM FOR FOLDED OR CONNECTED SHEET PRODUCTS

This application is a continuation, of application Ser. No. 07/132,989, filed Dec. 15, 1987, now abandoned.

Reference to related applications, assigned to the assignee of the present invention, the disclosure of which is hereby incorporated by reference: U.S. Ser. No. 060,764, filed Jun. 10, 1987, KOBLER et al, now U.S. Pat. No. 4,828,242, U.S. Ser. No. 056,857, filed May 29, 1987, KOBLER et al, now U.S. Pat. No. 4,807,865, U.S. Ser. No. 056,787, filed May 29, 1987, PETERSEN, now U.S. Pat. No. 4,775,136, U.S. Pat. No. 4,605,212, Kobler, to which German Patent 34 27 559 corresponds. U.S. Pat. No. 4,605,213, Hechler, to which German Patent Disclosure Document DE-OS 34 27 558 corresponds. German Patent Disclosure Document DE-OS 33 45 191.

The present invention relates to a transport system and more particularly to a transport system which can also be used as a storage system for folded or connected sheet products, and particularly for folded products which are to be stored in a compact storage arrangement.

BACKGROUND.

Various types of storage and transport systems for folded products or connected products, which are connected at a folded or creased back, or a stapled connection, are known. For example, U.S. Pat. No. 4,605,212, Kobler, describes an arrangement to receive and transport folded products. The products are received from a folding flap or folding groove-folding blade cylinder pair. An endless transport system is coupled with a t least one of the cylinder pairs. The transport system has carrier elements located thereon in predetermined distance, which engage from the side into the wedge-shaped region of a folded product between the folding blade - folding flap cylinder. These carrier products, coupled to the transport systems, thus can carry the folded prodcuts beneath the folded back. Storage of folded products guided and transported in this manner is effected after transfer to a storage system, described for example in U.S. Pat. No. 4,605,213, Heckler.

It is further known from German Patent Disclosure document DE-OS 33 45 191 to rol folded products by means of rolling belts or tapes so that they can be stored in a minimum of space. It is necessary insuch an arrangement to supply the folded products to the wind-up or roll-on device by transport belts or tapes. It is difficult to maintain the stability of positioning of the respective folded products. Maintaining the stability is only possible if the belt tension is high, which has the tendency, however, to damage the folded products, or cause, irreversibly, deformation thereof.

THE INVENTION.

It is an object to provide a transport arrangement for folded products, and one which, particularly, is adapted to be coupled to or itself form a storage system, so that folded products can be stored in a minimum of space, without having to transfer the folded products from the transport arrangement to a special storage or additional transport system, while maintaining the folded products, upon storage, in predetermined position.

Briefly, the transport means comprises an elongated element of finite length; the transport element, when placed in a predetermined position, defines a storage section, in which storage section the folded products are engaged directly or indirectly against the transport element with a sheet surface adjacent a transport surface or plane, which transport element can, at the same time, also function as a storage element or holder for the sheet products.

The system has the advantage that the transport element, itself, forms part of a transport system and at the same time form part of a storage system, when placed in the predetermined storage position. The predetermined storage position may, either, be a vertical or horizontal storage strip or rack or suspension, or in circular form, to form a storage roll.

DRAWINGS:

FIGS. 15 and 16 are, respectively, fragmentary enlarged side views of the attachment arrangement, in which FIG. 15 is a side view before attachment and FIG. 16 after attachment;

DETAILED DESCRIPTON.

The transport and storage arrangement is particularly suitable for processing of folded products. The arrangement is also suitable, however, to handle and process sheet-like products or elements whichare capable of forming a V-shaped structure, for example two sheets of paper or the like, or two sheets or flaps of cardboard, sheet metal, plastic or other materials which are connected along a side, for example by welding, adhesives, or the like.

In the description that follows, reference will be made to "folded products" for simplicity, since this is probably the most widely used application in practicing the invention; the referenced U.S. Pat. No. 4,605,212, to which German Patent 34 27 559 corresponds. Two or more single sheets, connected at tone side, are deemed to be equivalents. The folded products may be single folded sheets or packages or groups of folded sheets, for example a group of printed pages, folded over to define a fold edge or back.

Figure 1:
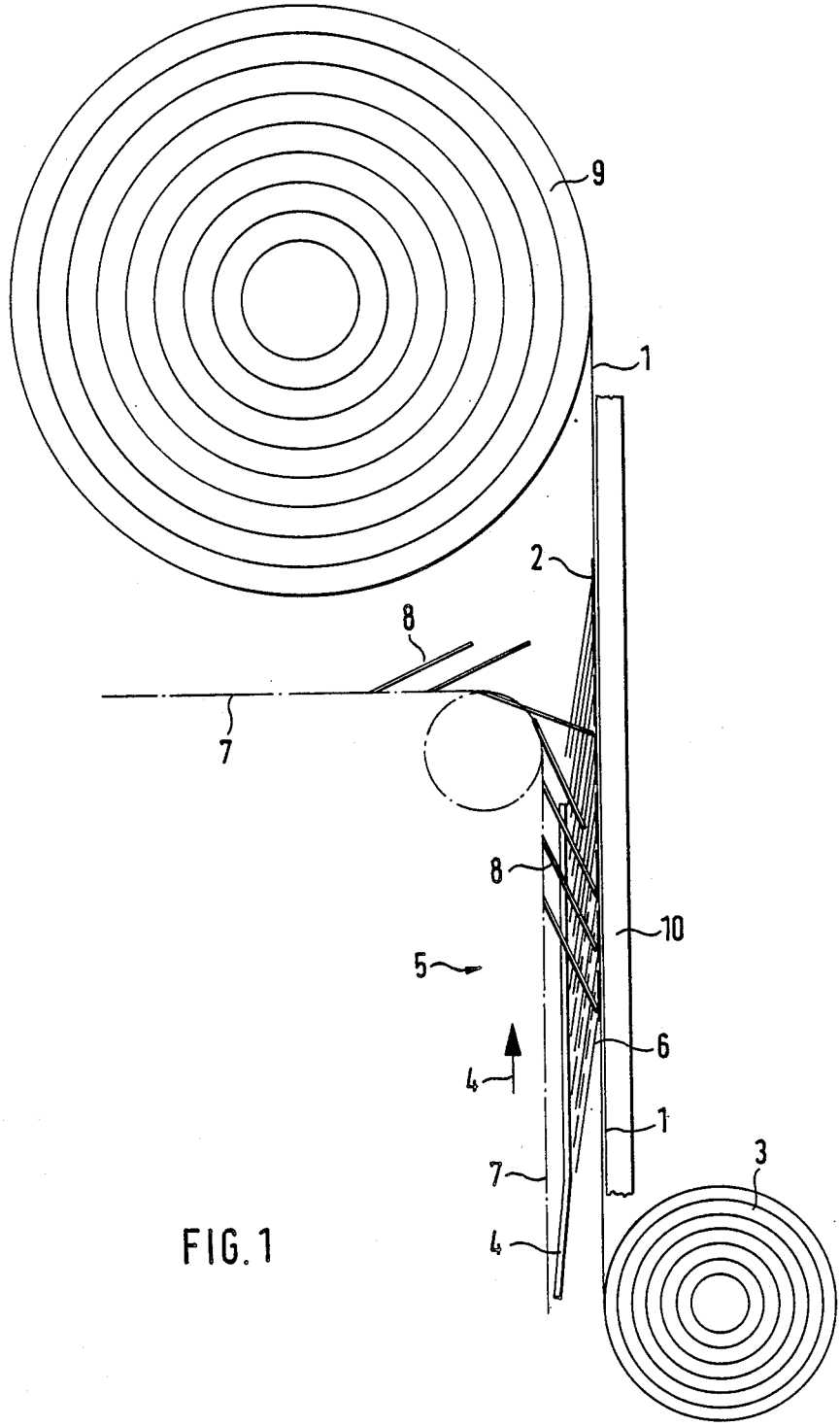
FIG. 1 is a highly schematic side view of the transport element wound in a storage roll.
Figure 3:
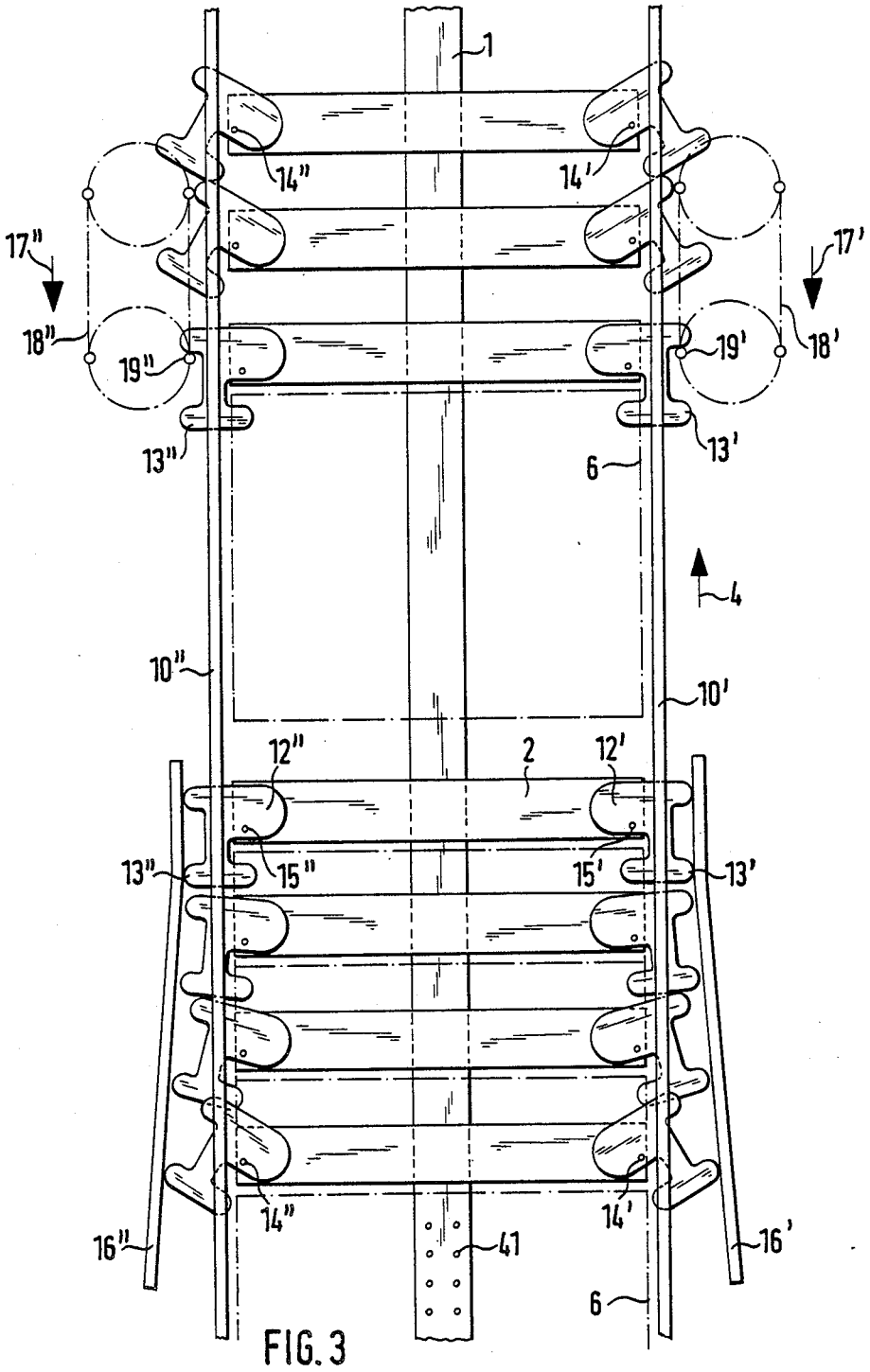
FIG. 3 is a top view of the transport element with controllable insertion fingers.

Referring now to FIG. 1: An elastic transport belt 1, for example a flexible steel tape, a plastic strip or the like, is used as the primary transport element. Transversely to the transport direction, carrier elements 2 which, are elastic, flat thin strips are located, at predetermined spacing or distances from each other, as best seen in FIG. 3. The transport belt 1 is drawn from a supply reel 3 in the direction of the arrow 4. Imbricated or shingle-like placed folded products 6 are placed on the transport belt 1 at a transfer position 5. In the embodiment illustrated, the folded products 6 are supplied from a transport chain 7 by carrying rods 8, secured to the transport chain, to supply the folded products 6 at a predetermined clock rate or in a predetermined cadence. A supply and transport arrangement of this type is known, see the referenced German Patent 34 27 559.

The present invention may also be used to receive folded products 6 without interposition of the transport systesm 7,8, for example directly from a folding apparatus. If so, the transport belt 1 should be guided along the folding apparatus, to receive the folded products 6, in the region 5 as described in German Patent 34 27 559, to be associated with the transport or transfer device thereof. As a general principle, the system of the present invention is thus suitable both for transporting as well as for storage of folded products in a compact space, without requiring a change in transport systems, that is, transition from a special transport system to a special storage system.

Figure 2:
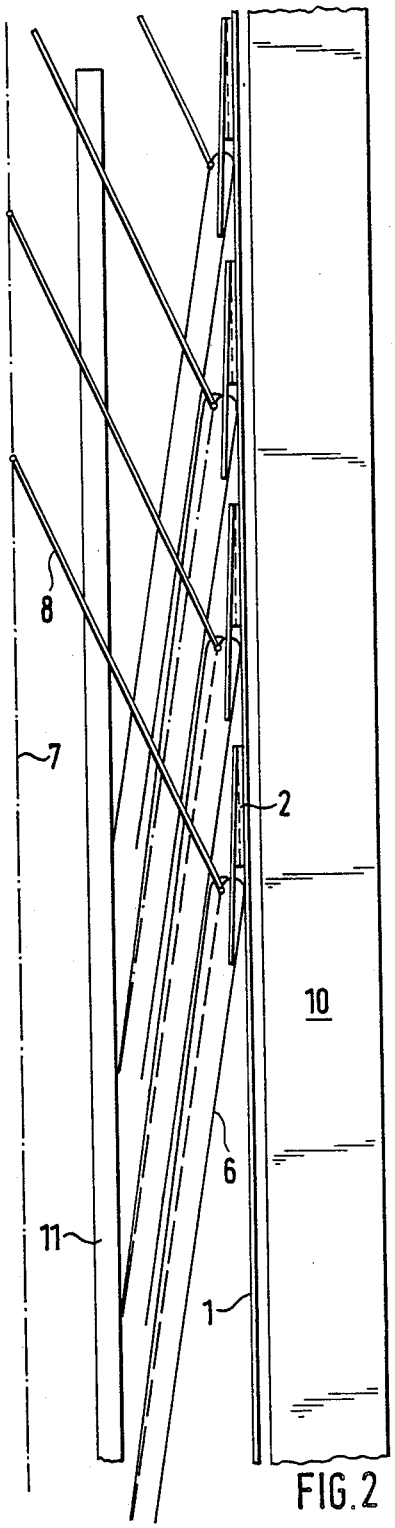
FIG. 2 is a fragmentary lateral view, to an enlarged scale, of the storage element of FIG. 1.

As best seen in FIG. 1, the transport belt 1 is wound into a storage roll 9 after the folded products 6 have been placed thereon. The storage roll 9 is coupled to a suitable drive reel, to provide for wind-up of the tape 1, with the folded products 6 thereon, carried thereon and held by the flat carrier fingers 13 (FIG. 3). Due to the precise and defined guidance, or holding, respectively, of each one of the folded products 6 on a carrier element 2, the position of the folded products at predetermined locations is always ensured. the transport belt 1 may be guided, at least in front of the storage roll 9, on guide rails 10 (FIG. 2). The storage roll 9 as such need not have any special arrangement for the guide rails 10, since the respectively lowest position of the transport belt 1 always insures guidance for the overall wind-up roll. The center position of the wind-up roll may be arranged to be shifted transverse to the wind-up direction to accomodate ever increasing diameters thereof.

The transport belt 1, as well as the fingers 13 on carrier elements 2, preferably, are made of flexible steel strip or tape. It is recommended and desirable to support the transport belt 1 as well as the fingers during and after transfer of folding products 6 thereon to support the weight thereof, for example by use of the guide rails 10, 11 (FIG. 2). Transfer of folded products on the transport system, and release of folded products from the transport system, is best seen in FIG. 3. The transfer station can be placed in advance or behind a linear portion of the storage section. The transversely extending carrier elements 2 are secured to belt 1, for example by spot welding.

In the description that follows, elements which are symmetrical to a center line will be given the same reference numerals, with the respectively right and left position element being indicated by prime and double prime notation.

The carrier elements 2 have pivotable, flat, springy fingers 13', 13'' located adjacent their end positions, pivotable about pivot points 12', 12''. The fingers 13', 13'' are held in two respective end positions by positioning or engagement depression-bumps 14', 14'' and 15', 15'', so that the fingers will be positively held in either open or closed position the resiliency of the fingers ensuring positive engagement of the depressions over the bumps while permitting release and pivoting of the fingers. The lower region of FIG. 3 illustrates the fingers 13', 13'' in open position, ready to receive folded products 6. The fingers run against guide rails 16', 16'' and are pressed by the guide rails from engagement with the locating points 14', 14'' into engagement with the locating points 15', 15''. Thus, the fingers will be held in predetermined position, permitting engagement, laterally, into the folded produts 6 which are held open with a gap, being received from the carrier rods 8 (FIG. 2). The carrier rods 8have an angled portion extending into the fold line of the folded products. After the fingers 13', 13'' have engaged in the V of the folded products, the carrier rods 8 are pulled out laterally, as seen in FIG. 2. The carrier rods 8 are pulled out from the folded products 6, supported from the rail 11 only after the fingers have penetrated into the fold.

To release the fingers, for example for further transport or removal of the folded products, or after storage in a storage system (FIGS. 1 and 2; not shown in FIG. 3), the fingers must be opened. To open the fingers, the transport belt 1 with the carriers 2 thereon, is moved in a region where two endless chains 18', 18'' are positioned adjacent the rails 10. The endless chains 18', 18'' have pins 19', 19'' engage with projections formed on the fingers 13', 13'', as best seen in FIG. 3, and when the fingers have reached the topmost position as shown in FIG. 3, they will be open, engaged with the stop position 14', 14'', at which point they will be released from engagement with the folded products to permit the folded proructs to be processed or handled in any suitable or desired manner.

Figure 6:
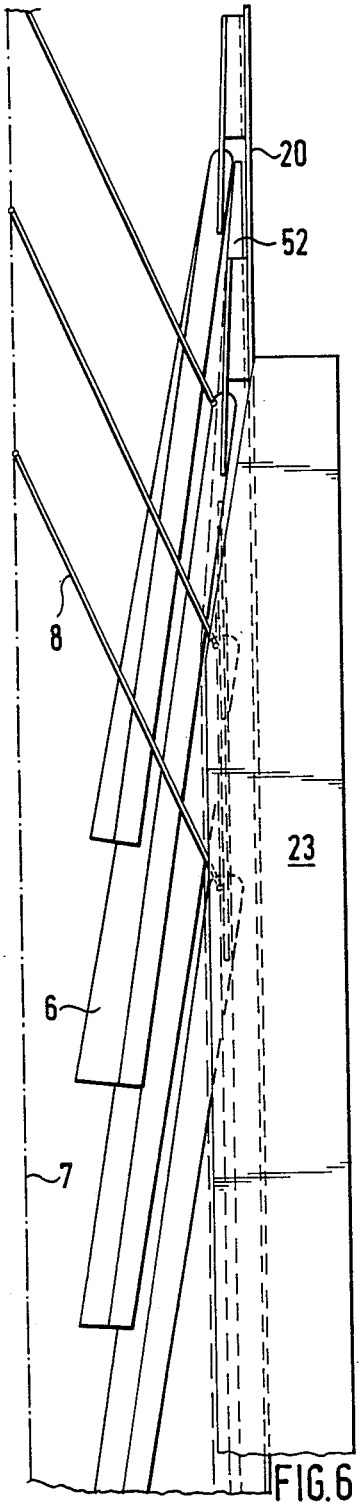
FIGS. 6 and 7 are, respectively, fragmentary side views of the system of FIGS. 4 and 5.
Figure 5:
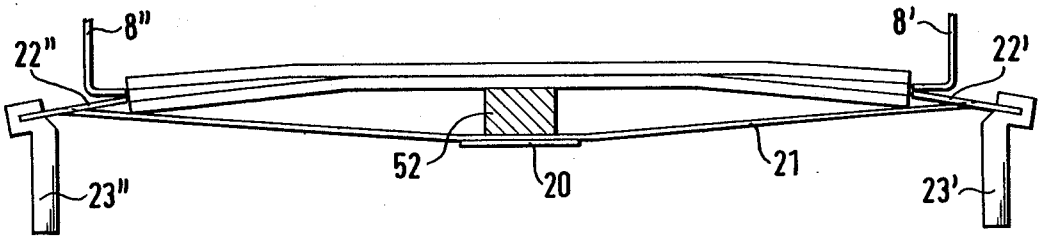
FIG. 5 is an end view thereof, showing bowing of folded products for their reception on the transport element of FIG. 4.
Figure 4:
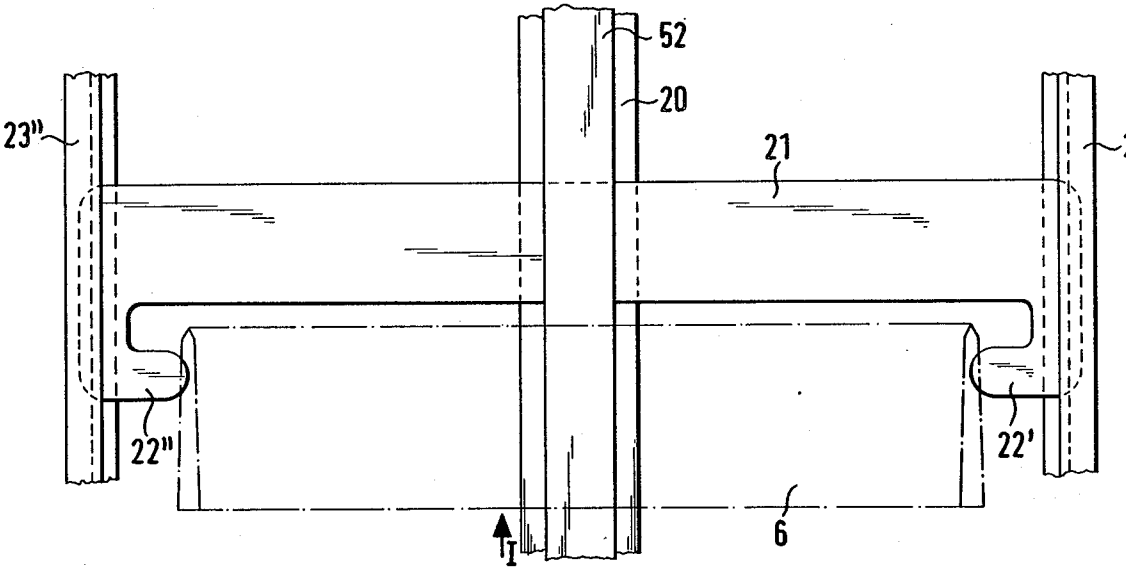
FIG. 4 is a top view of a modified transport element.
Figure 7:
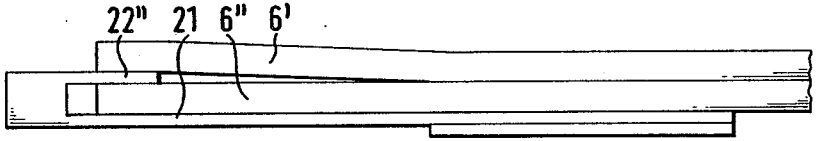

EMBODIMENT OF FIGS. 4–7:

Folded products 6 can be transferred to the transport system in another manner. The flexibility of steel strips or tapes is sued. A transport belt 20, formed of a steel strip, for example thin spring steel, has flexible, flat cross arm carriers 21 secured thereto which are formed at their ends with hook-like fingers 22', 22''. The fingers are guided in tracks or rails 23', 23''. For receiving folded products 6, as well as upon transferring folded products 6 from the transport systems, the cross arms 21 are so deformed, by flexing, upon engagement with the rails 23', 23'', that products 6 can be received as shown schematically in the end view of FIG. 5. FIG. 5 is a view taken along the arrow I of FIG. 4. FIG. 6 is a lateral view of the same transfer operation; FIG. 7 illustrates the position of the hook-like end finger 22' between two halves 6', 6'' of a folded sheet after the folded sheet has been transferred to the transport system.

A center rail 52 (FIGS. 4, 5) so bends the sheets 6 as well as the strip 20 and the cross arms 21 secured thereto that, first, the sheets are bowed, to permit the fingers 22', 22'' to engage therein, and then the rail 52 tapers, as seen in FIG. 6, to permit the sheets to flatten out and the fingers 22', 22'' to engage in the folded of the folded sheets.

EMBODIMENT OF FIGS. 8 AND 9:

Two elastic belts 24', 24" are used rather than a single central belt. The fingers 25', 25" are secured to the belts 24', 24". This arrangement has the advantage that it can be readily adapted to folded products 6 of different widths. The two transport belts 24', 24" are guided inrails or tracks 26, 26". Lateral rails 27', 27" are used to guide the fingers 25', 25". The folded products 6 are placed on guide sheets 28', 28", and are transported by driven belts 29, 30 until the sheets can be engaged by the fingers 25', 25".

Figure 9:
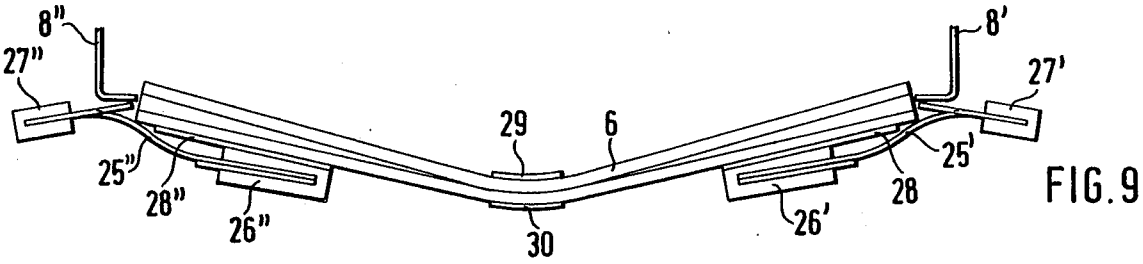
FIG. 9 is a view similar to FIG. 5, illustrating another modification, using two parallel belts.

Transfer of folded sheet products 6 is best seen in FIG. 9. The steel belts 25', 25" are flexed by engagement with the rails 26', 27', 26", 27". This engagement with the rails also flexes the fingers 25', 25"; the folded products 6 are flexed by engagement with belts 29, 30, and the guide sheet 28.

Figure 8:
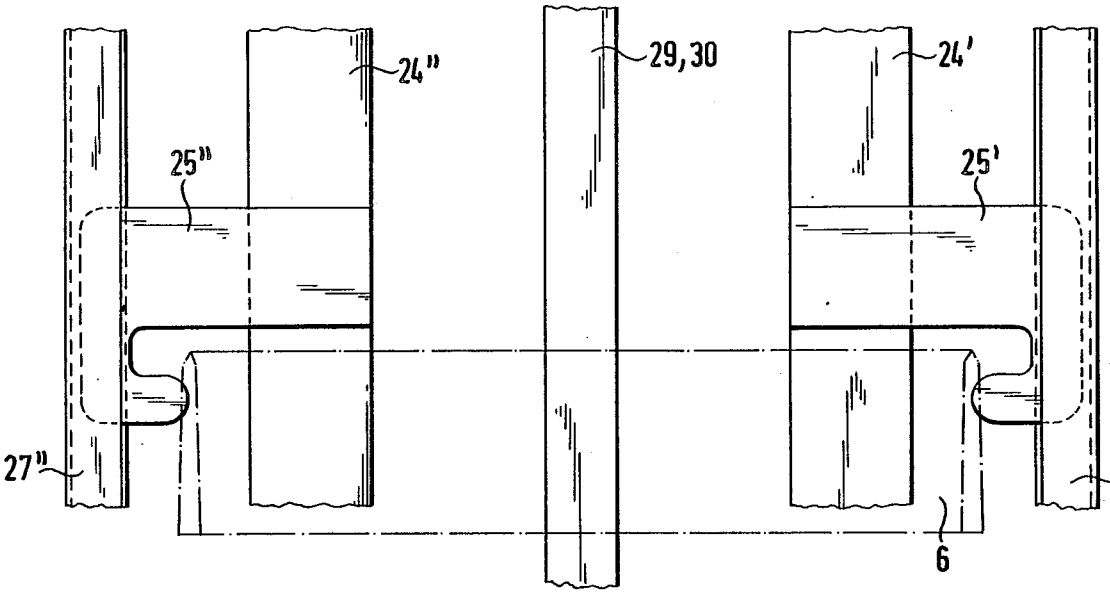
FIG. 8 is a view similar to FIG. 4, illustrating another modification.
Figure 12:
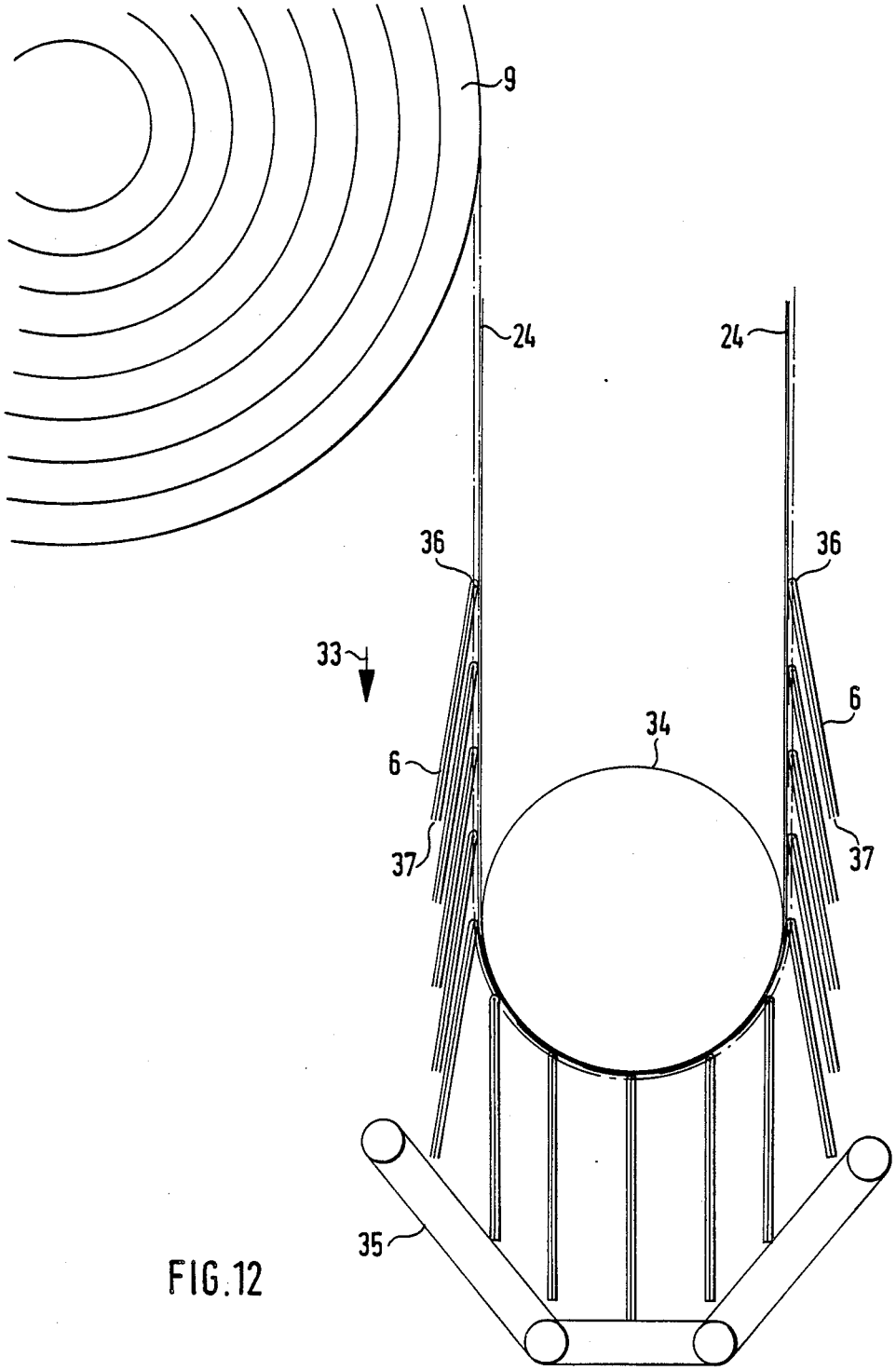
FIG. 12 is a schematic end view of the arrangement of FIG. 10, illustrating the path of the transport belts.

EMBODIMENT OF FIGS. 10 AND 11:

The arrangement is similar to that described in connection with FIGS. 8 and 9, except that the fingers are somewhat different. Thus, fingers 31', 31" have pins 32', 32" secured thereto. This permits turning over of folded products 6 by rolling off a roll 9 (FIG. 12) in the direction of the arrow 33. The folded products 6 will then hand downwardly, under influence of gravity. Upon rolling off the belt in the direction of arrow 33, and guiding the belt about a roller 34, the sheets are turned. Thus, after rolling off the folded products 6 from the storage roll 9, with the open sides of the folded products 6 at the leading edge, they will then be transported with the folding edge or back at the leading side. Turning of the folded product 6 is assisted by a belt system 35, which includes driven belts, and located in a position similar to that shown in FIG. 12, that is, roughly V-shaped. This belt, also, is used to guide the sheets as they are folded over and to prevent the sheets from flying outwardly under centrifugal force at the terminal ends of the folded products. When winding folded products first, they are would in a direction counter the direction of the arrow 33, that is, with the folded bakc 36 at the leading side. This is the customary way of winding folded products, described for example in German Patent Disclosure Document DE-OS 33 45 191. Upon rolling off, that is, rolling off in direction of the arrow 33, the folded products will be available in a manner undesired for further processing, that is, with the open side 37 at the leading side. Consequently, they must be re-spooled. The arrangement of FIG. 12 is particularly suitable since, in combination with the system of the present invention, it permits ready re-orienting of the folded products upon removal from a storage roll, so that they will be acceptable for further processing with the folded back 36 at the leadingside.

Figure 11:
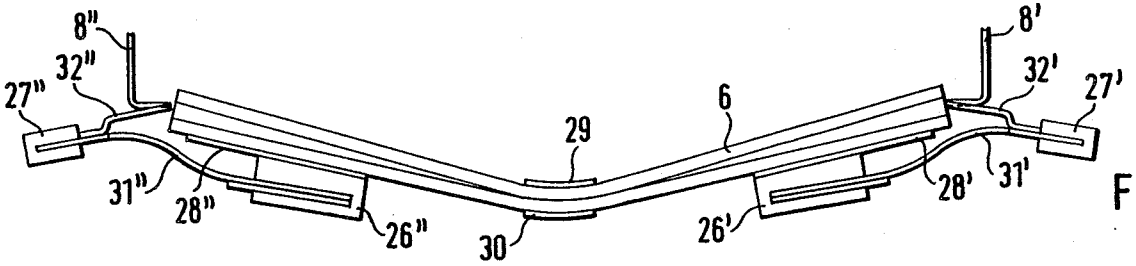
FIG. 11 is a side view of the arrangement of FIG. 10.
Figure 10:
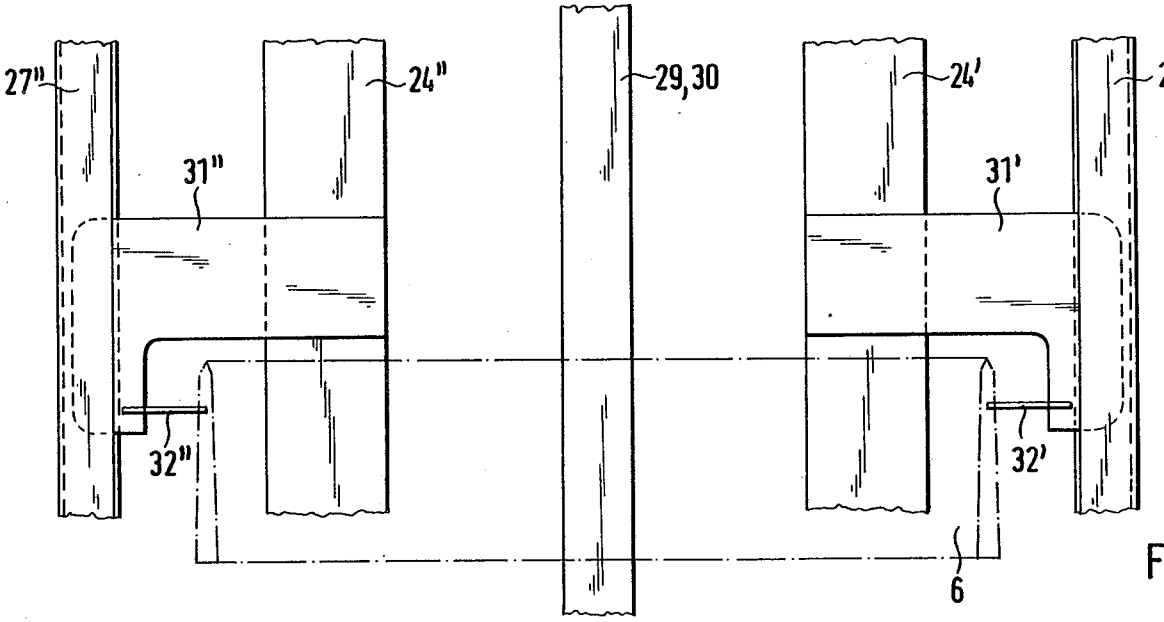
FIG. 10 is a top view of an arrangement illustrating a possibility to turn over an imbricated stream of folded products.
Figure 17:
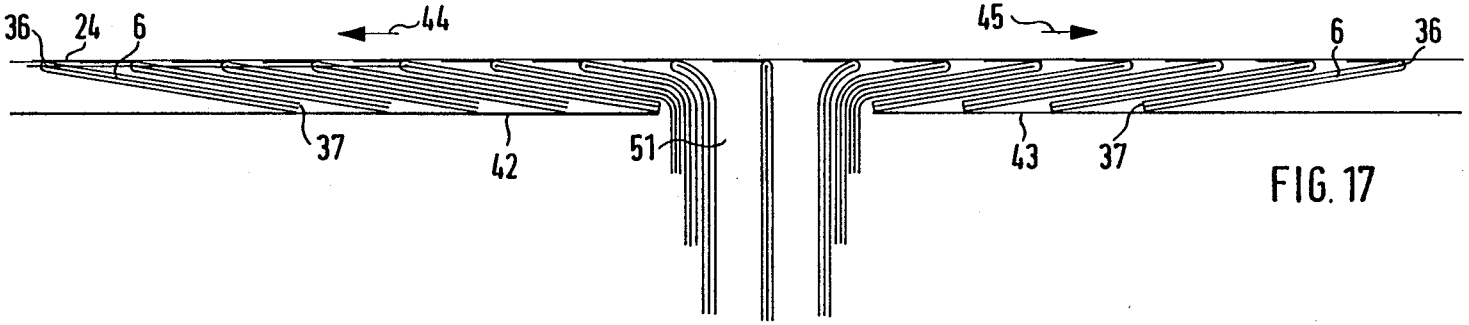
FIG. 17 illustrates another arrangement to turn over a stream of imbricated folded products.

EMBODIMENT OF FIG. 17:

The turning of the imbricated group of folded products can also be done in a linear transport or storage system. The folded products 6 are first transported to a storage system, for example, with the folded back of fold edge 36 at the leading side. A guide sheet 42 supports the folded products. When the folded products are then transported, still in the position, counter the direction of arrow 44, and as shown by the arrow 45, the folded products 6 are permitted to hang freely in a gap between the guide sheet 42 and the guide sheet 43 and, when the folded products meet the guide sheet 43, they are thereby turned, so that, again, the folded back 36 will be leading. FIGS. 12 and 17 also show, schematically, a belt 24, which may be a single belt or represent either one of the belts 24', 24" (FIGS. 10, 11).

Figure 19:
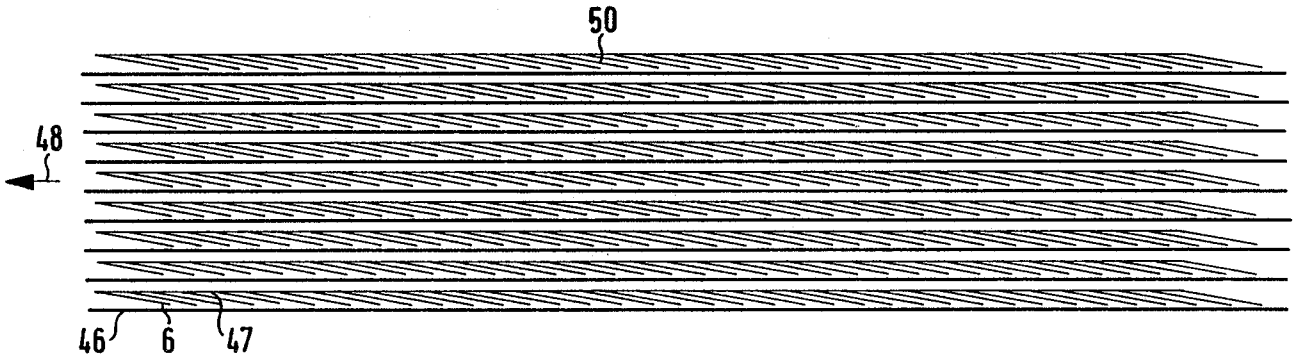
FIG. 19 is a top view of the arrangement of FIG. 18.

EMBODIMENTS OF FIGS. 18 AND 19:

The storage system need not store the folded products in a roll; rather, they may also be stored in a parallel arrangement, for example horizontally or, preferably, vertically, by hanging the folded products and letting them fall against each other by gravity. As in the formation of a storage roll, a transport belt 47 of finite length is used. The belt 47 may be constructed as above described, for example of the belt strips or tapes 1, 20, 24. A pulling device, not further shown and which may be of any standard construction, is used to pull folded products 6 which are secured to a belt and retained between a guide sheet 46 in the direction of the arrow 49 (FIG. 19). When needed, the folded products can be pulled off in the direction of the arrow 48, with the folded back 36 leading, for further handling.

Figure 13:
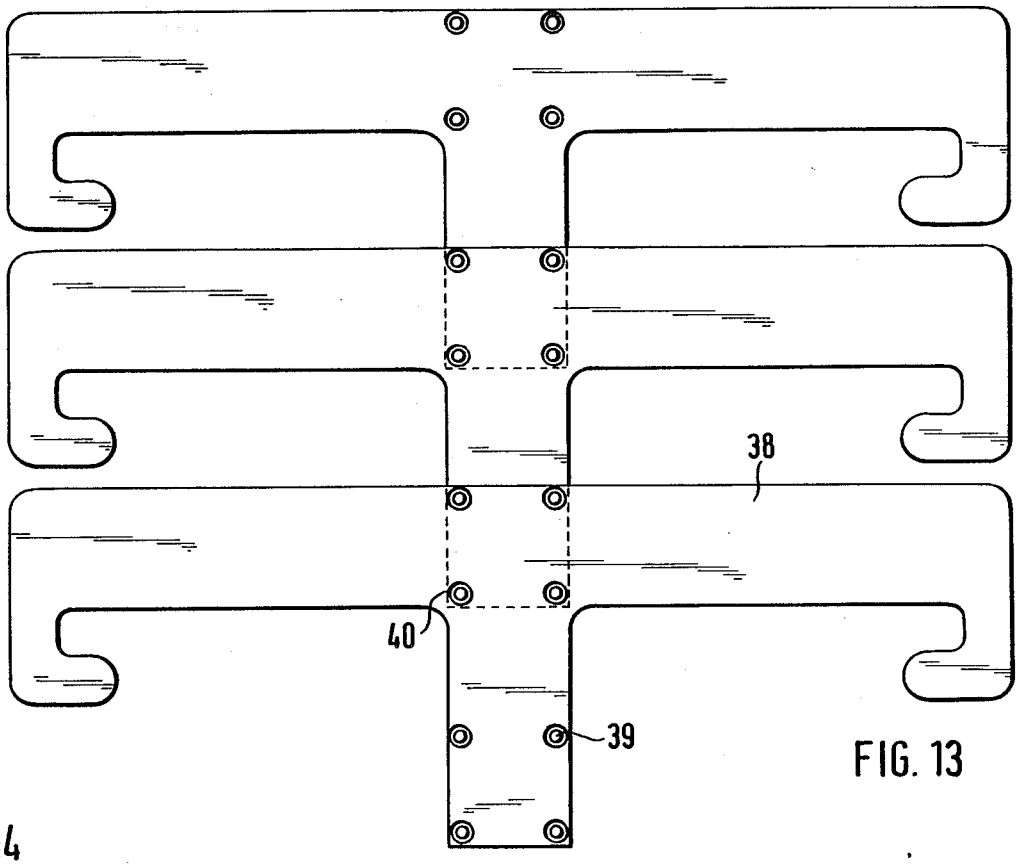
FIG. 13 is a top view of an arrangement to extend the length of a storage element.
Figure 14:
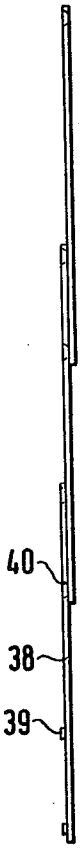
FIG. 14 is a side view of the arrangement of FIG. 13.
Figure 15:
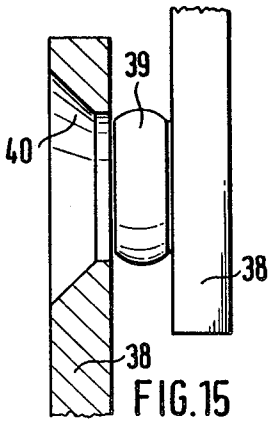
Figure 16:
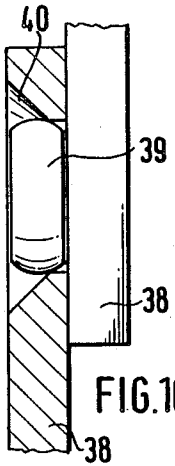

Details of the construction of fingers or cross arms (FIGS. 13–16), for belts 1, 20, 24 or 47: The association into a transport and storage system of any desired length is obtained by a resilient button connection. As best seen in FIG. 15, a button-like bolt element 39 is welded to the underside of the transport belt, the cross element or any suitable structure of the system, shown generally at 38. The upper parts of the system are formed with complementary openings 40 which, as seen in FIG. 15, have slightly tapered walls with a slightly constricted opening. Any suitable device, not shown, and storing the elements 38, is then taken from the storage holder and guided, in controlled cadence, between a pair of pressure rollers to snap the bolts 39 which, preferably, have rounded cross section as seen in FIG. 15, into the opening 40, to form the connection seen in FIG. 16. For separation, the elements can be passed through a wedge-shaped separating zone, for individual storage. The enlarged detail views of FIGS. 15 and 16 illustrate the elements 38 before and after connection. FIG. 14 is a side view of a plurality of elements connected together. As seen in FIG. 13, individual holder elements 38 which, as such, include a transport portion as well as a finger and transverse holding portion, may be used, to form an overall transport belt arrangement of suitable length.

The central portion of the structure 38 (FIG. 13) as well as any one of the transport belts are preferably tansported in continuous manner by engagement by sprocket holes, shown schematically as openings 41 in FIG. 3. Any other arrangement to transport the belts may be used, for example by forming the belts with teeth, rectangular cut-outs or the like, for engagement with a driven sprocket wheel.

Figure 18:
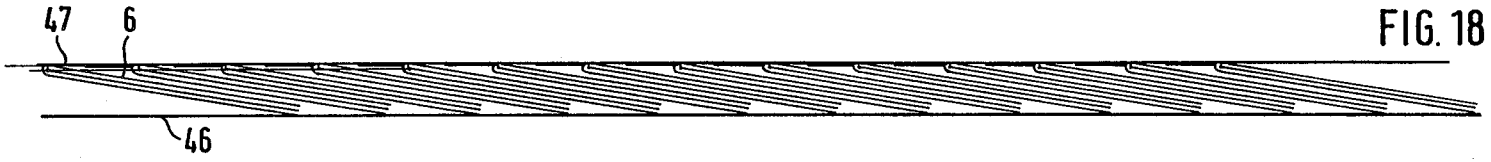
FIG. 18 is a schematic side view of a linear imbricated folded product storage arrangement.

Various changes an modifications may be made, and features described in connection with any one of the embodiments may be used with any of the others. As best seen in the various embodiments, the principle of the present invention is directed to a system in which folded products 6 can be stored in a suitable manner, for example in roll form (FIG. 1) or longitudinally (FIGS. 18, 19). For example, the arrangements illustrated in FIGS. 18, 19 may be stored vertically, by vertical hanging of the respective tapes or belts. A plurality of such linear storage elements of finite length can be located adjacent each other, horizontallya s well as vertically.

This permits compact storage of folded products in minimum space.

I claim:

1. Compact transportation system to transport folded or connected sheets defining a connecting back along a transport surface, or transport plane, said system comprising a storage position defining a storage surface or plane;

transport means including an elongated flexible transport element (1) of finite length, said transport element (1) being positionable at the storage position;

flat, elastic sheet holder means (2, 21, 22) on said transport means and arranged to engage laterally into and between the sheets between the connecting back with the flat surface of said holder means being located parallel to and against portions of the flat sides of the sheets; and guide means (10, 11) positioning said transport element (1) at the transport surface or plane;

said elongated transport element retaining the sheets thereon with the sheet surfaces which face the transport surface being positioned directly or indirectly adjacent the transport surface or plane when the transport element is at said storage position.

2. The system of claim 1, wherein said elongated transport element (1, 20, 24) comprises an elastic strip or belt of plastic or steel.

3. The system of claim 1, wherein said elongated element, when at the storage position, defines a storage section (9) which includes a curved portion, said curved portion being curved with respect to the transport surface or plane.

4. The system of claim 3, wherein the curved portion of the elongated transport element forms a rotatable storage roll or reel in which the elongated element isguided by the respective outermost winding layer of the roll or reel.

5. The system of claim 1, wherein (FIGS. 18, 19) the elongated element, when at the storage position, defines a storage section (50), said storage section being essentially linear; and wherein guide elements (46) are provided, to guide the sheet products towards a plane surface within which said transport element is movable.

6. The system of claim 5, wherein (FIG. 17) the guide elements (42, 43) include guide sheets formed with an opening (51) which permits, upon movement of said transport element, to reverse the position of the backs of the sheets with respect to the transport direction.

7. the system of claim 1, wherein said transport element (1, 20) comprises an elastic central elongated strip element (1, 20) and a plurality of transversely extending elastic, flat carriers (2, 21, 38), and elastic, flat hook-like holder elements (13, 22) located at termnal portions of said carriers, said carriers and holder elements forming at least in part said sheet holder means.

8. The system of claim 7, wherein (FIG. 3) said holder means comprise holder fingers pivotably secured to said carrier elements;

and control means (16, 18) are provided, positioned with engagement with said fingers to pivot said fingers between two defined positions to, respectively, engage said folded sheets beneath the connecting back, or release said sheets from said transport system.

9. The system of claim 7, wherein (FIG. 4) said holder elements comprise hook-like fingers secured to said carriers;

guide rails (23, 52) are provided engaging said carrier elements and flexing said carrier elements for, respectively, engagement of the fingers beneath the connecting back, or release of said fingers from beneath the connecting back to release said sheets from the transport means.

10. The system of claim 1, wherein (FIGS. 8–11) two elongated elements of finite length are provided, forming said carrier means, and extending parallel to each other;

holder elements (25, 31) projecting away from a neighboring carrier element being secured to said carrier elements;

and guide rails (26, 27) are provided, engageable with at least one of said carrier elements and said holder elements and the sheets (6) for deflecting the sheets and the carrier elements for, respectively, engagement of the holder element from the connecting back of the sheets or disengagement therefrom.

11. The system of claim 1, further including a deflection roller (34) positioned for guidance of the elongated element thereabout to permit change of position of the back of the sheet products (6) with respect to transport position upon reversal of movement of said elongated element about said roller (34).

12. The system of claim 11, wherein said roller is positioned with respect to said elongated element at a lowermost position, said elongated element being wrapped about said roller to place said roller at the bottom of a U-shape portion of the elongated element, arranged in vertical orientation.

13. The system of claim 12, further including a guide transport belt means (35) located spaced from the bottom of the U portion of the transport element to guide free ends of the sheet products (6) upon movement of said deflection roller (34).

14. The system of claim 1, wherein said elongated element includes a storage section;

and wherein said storage section is arranged to have a variable length.

15. The system of claim 14, wherein (FIGS. 13–15) the storage section includes at least one strip element and carrier elements selectively attachable to the strip elements, said strip element and carrier elements being formed with interengaging snap button-and-recess means (39, 40) for selective placement of carrier elements on said strip elements to provide storage sections of variable length.

16. The system of claim 1, wherein the transport surface or plane is a planar surface.

17. The system of claim 1, wherein said transport surface or plane is a planar surface; and wherein the storage position defines a storage surface which is curved with respect to the planar transport surface.

18. The system of claim 17, wherein the elongated element, at the storage position, forms a rotatable storage roll or reel in wich the elongated transport element is guided by the respective outermost winding layer of the roll or reel.

* * * * *